US006841012B2

(12) United States Patent
Croce

(10) Patent No.: US 6,841,012 B2
(45) Date of Patent: Jan. 11, 2005

(54) ANTI-TARNISH SILVER ALLOY

(75) Inventor: Scott M. Croce, East Brunswick, NJ (US)

(73) Assignee: Steridyne Laboratories, Inc., East Brunswick, NJ (US)

( * ) Notice: Subject to any disclaimer, the term of this patent is extended or adjusted under 35 U.S.C. 154(b) by 0 days.

(21) Appl. No.: 10/636,006

(22) Filed: Aug. 7, 2003

(65) Prior Publication Data

US 2004/0219055 A1 Nov. 4, 2004

Related U.S. Application Data

(60) Provisional application No. 60/466,207, filed on Apr. 29, 2003.

(51) Int. Cl.[7] ..... C22C 5/00

(52) U.S. Cl. ..... 148/430; 420/504; 420/506

(58) Field of Search ..... 420/504, 506; 148/430

(56) References Cited

U.S. PATENT DOCUMENTS

| | | | | |
|---|---|---|---|---|
| 3,811,876 A | | 5/1974 | Harigaya et al. | |
| 4,453,977 A | * | 6/1984 | Burns et al. | 75/255 |
| 4,810,308 A | | 3/1989 | Eagar et al. | |
| 4,869,757 A | | 9/1989 | Eagar et al. | |
| 4,973,446 A | | 11/1990 | Bernhard et al. | |
| 5,021,214 A | | 6/1991 | Sasaki et al. | |
| 5,037,708 A | | 8/1991 | Davitz | |
| 5,039,479 A | | 8/1991 | Bernhard et al. | |
| 5,171,643 A | | 12/1992 | Suzuki et al. | |
| 5,558,833 A | | 9/1996 | Zamojski | |
| 5,817,195 A | | 10/1998 | Davitz | |
| 5,882,441 A | | 3/1999 | Davitz | |
| 6,139,652 A | | 10/2000 | Carrano et al. | |
| 6,726,877 B1 | * | 4/2004 | Eccles | 420/504 |

FOREIGN PATENT DOCUMENTS

| | | | |
|---|---|---|---|
| JP | 60159533 | | 1/1987 |
| WO | WO 95/14112 | * | 5/1995 |

* cited by examiner

*Primary Examiner*—John P. Sheehan
(74) *Attorney, Agent, or Firm*—Hoffman & Baron, LLP

(57) ABSTRACT

An anti-tarnish silver alloy is provided including at least about 85% silver, with the balance including zinc, copper, indium, and tin. Also provided are articles made from the alloy and methods of making the articles.

21 Claims, 1 Drawing Sheet

ANTI-TARNISH SILVER ALLOY

CROSS-REFERENCE TO RELATED APPLICATIONS

This application claims priority to U.S. Provisional Patent Application No. 60/466,207, filed on Apr. 29, 2003, which is herein incorporated by reference in its entirety.

FIELD OF THE INVENTION

The present invention relates generally to silver alloys, more particularly to sterling silver alloys having improved tarnish resistance for use in materials such as jewelry and tableware, as well as electrical applications.

BACKGROUND OF THE INVENTION

Silver alloys has been used for the manufacture of articles such as decorative jewelry and tableware, as well as other formed, extruded and molded pieces for many years. The main element in these alloys is silver, a precious metal desirable for its bright white color tone. However, use of pure silver alone is not feasible due to its lack of inherent hardness.

Alloys of silver have traditionally been used to improve hardness and other qualities. The use of copper (Cu) is known for improving the hardness of silver. Other additional elements can be useful in imparting desirable qualities to silver metal. Advantages to the use of various silver alloys include their amenability to being cast from molten metal, malleability, and strength or hardness.

The presence of copper in a silver alloy can be problematic as copper has a propensity to form discoloring sulfides and chlorides. Additionally, silver-copper alloys often oxidize to form a black- or red-colored blemish commonly known as "fire scale". It is believed that fire scale is copper oxide. The cupric variety will produce a blackened blemish, whereas the cuprous variety will form a reddish blemish. In either case, this blemish is not limited to the surface of the article, as in the case of superficial tarnish (typically silver sulfide), but may penetrate the article more deeply. In some cases, the penetration is such that the defect or blemish cannot be removed by buffing and polishing.

Consequently, a disadvantage of currently available silver alloys, which include substantial amounts of copper to maintain hardness, is their tendency to form fire scale and/or become tarnished. Such tarnish can occur from oxidation which results from exposure to air and/or sulphurization which results from exposure to sulfur from atmospheric contamination, or, for example, skin contact. The discoloration is usually treated with an appropriate polish to remove the discoloration. Such treatment must be performed regularly in order to maintain the beauty and condition of the article. The discoloration is a principal drawback to greater popularity of silver jewelry.

A number of silver alloys have been developed to attempt to minimize the amount of discoloration occurring on the surface of articles made from such alloys, while maintaining advantageous qualities of strength and the like. U.S. Pat. No. 3,811,876 to Harigaya et al. discloses a silver alloy including tin (Sn), zinc (Zn) and indium (In), with a balance being silver. The combination of Sn, Zn and In with the silver was found to have a synergistic effect in reducing sulphurization of the alloy. However, these alloys will lose their sulphurization resistance if contacted with conventional phosphoric flux containing polish used as deoxidizing agents.

U.S. Pat. No. 5,817,195 to Davitz discloses a silver alloy including nickel (Ni), metal silicate, Zinc (Zn), Copper (Cu), with a balance being silver. The alloy may also contain up to 0.5% Indium (In).

U.S. Pat. No. 5,021,214 to Sasaki et al. discloses a silver alloy including indium (In), aluminum (Al), and copper (Cu). The use of indium and aluminum is indicated as a substitute for conventional palladium (Pd) in providing xanthation resistance without the expense associated with the use of palladium.

U.S. Pat. No. 6,139,652 to Carrano discloses silver alloys. The alloys include silver and an added element which consists essentially of at least one oxide of aluminum, antimony, cadmium, silicon, titanium, and zinc. The oxide is effective to improve tarnish resistance of the alloy. By using certain processing techniques, it is possible to also increase the annealed hardness of the alloy.

U.S. Pat. No. 4,973,446 to Bernhard et al discloses silver alloys. The alloys consist essentially of silver, silicon, boron, zinc, copper, tin and indium. The alloy provides an improved porosity and grain size as well as reducing fire scale. However, this alloy includes copper in amounts that contribute to tarnish.

There is an acute need for silver alloys which maintain the advantage of strength and ease in manufacture while reducing the amount of corrosion and/or tarnish of articles made therefrom.

SUMMARY OF THE INVENTION

The present invention provides a silver alloy having desirable properties including tarnish resistance as well as having sufficient strength and workability to be useful in making a wide variety of silver articles. The silver alloy is particularly useful in making fine sterling silver jewelry.

A silver alloy is provided including at least about 85% silver, with the balance including zinc, copper, indium and tin. Optionally, the alloy also includes iron or gold. Preferably, the alloy contains one or more relatively small amounts of, silicon, manganese, boron, bismuth, cobalt, chromium and lead. In certain applications, all of the above elements are present, in addition to vanadium, cerium, iridium, and zirconium.

In a further aspect of the present invention, a sterling silver alloy is provided including silver in a range of from about 92.5% to about 95% by weight with a balance including zinc in an amount up to about 5% by weight, copper in an amount up to about 1.5% by weight, indium in an amount up to about 0.2% by weight, tin in an amount up to about 2% by weight; and at least one metal selected from the group of: gold (Au), copper (Cu), indium (In), zinc (Zn), tin (Sn), iron (Fe), silicon (Si), manganese (Mn), boron (B), bismuth (Bi), cobalt (Co), chromium (Cr), lead (Pb), vanadium (V), cerium (Ce), iridium (In), and zirconium (Zr).

Also provided is a method of making an article from an alloy according to the present invention including the steps of pre-forming an alloy of the invention into a pre-formed piece, melting the piece, casting the melted piece into a mold to form a cast article, cooling the cast article, and removing the cooled article from the mold. Optionally, residual alloy from the casting step may be reworked into a virgin alloy for use in making subsequent articles.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The figure is a photograph illustrating the degree of tarnish of silver alloys according to the invention identified as QLS-7 and QLS-8 as compared to known silver alloys identified as QLS-9, QLS-10, NAGAOKA and ULTRAFINE, after exposure to a tarnish producing environment.

DETAILED DESCRIPTION OF THE PREFERRED EMBODIMENTS

Figure 1:
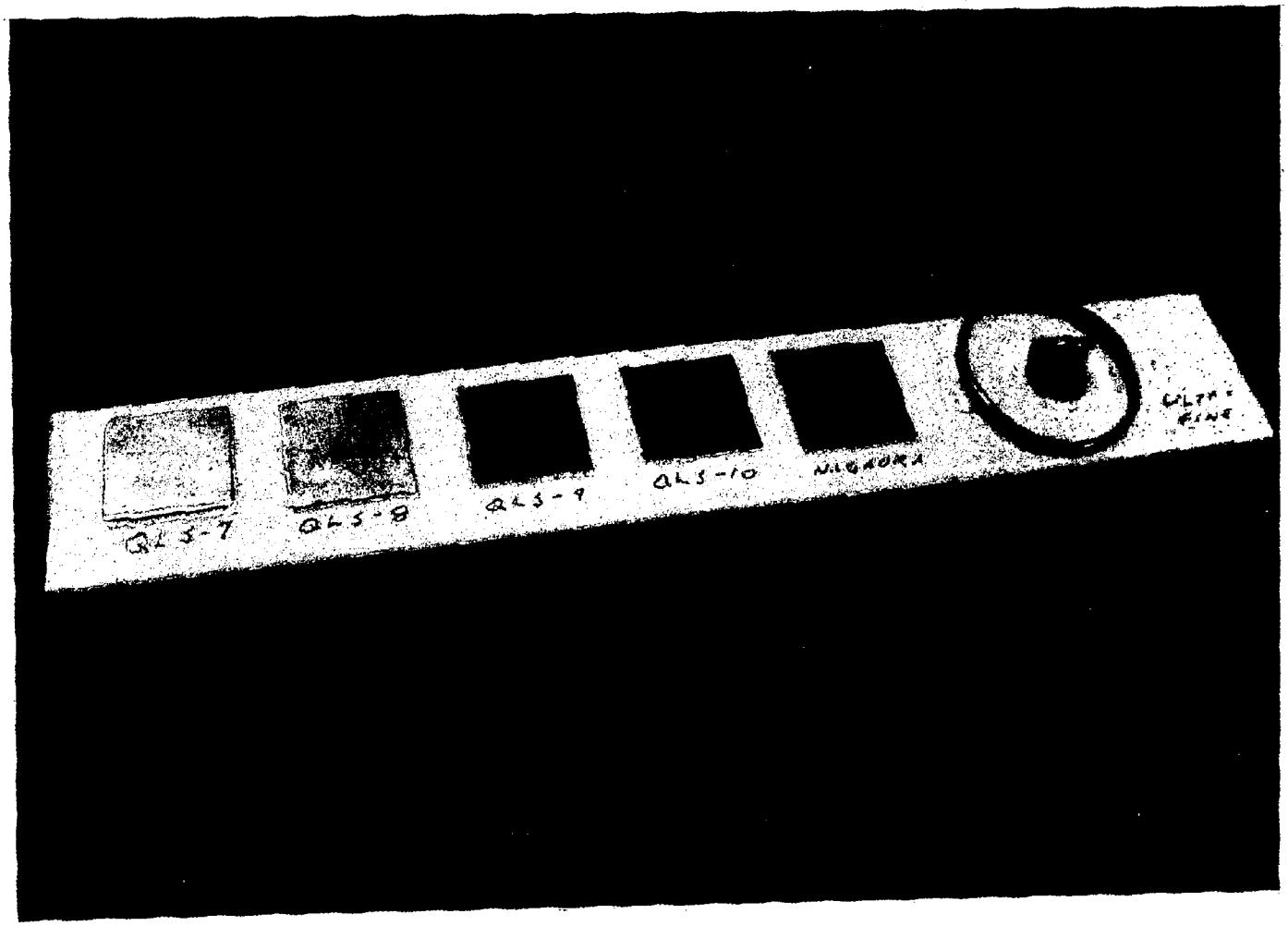

The inventor has found that a highly tarnish resistant silver alloy, suitable for use in a variety of products, may be obtained by combining certain additional metals with silver. The alloy of the present invention provides an alloy of superior quality which possesses sufficient hardness without the necessity to perform additional steps of annealing or reheating. Due to the properties of tarnish resistance and hardness, the alloy of the present invention is particularly suited for use in making fine silver jewelry.

Composition of the Alloy

In general, the alloy includes at least about 85% silver. The amount and quality of silver present in the alloy is dictated by the intended use of the alloy. Generally, at least about 85% is necessary in order to maintain sufficient conductivity and other electrical properties for use in electric contacts and the like. In order for the quality of the silver alloy to be considered "sterling" the alloy must include at least 92.5% by weight of silver. Preferably the silver used has a purity of at least about 99.99%.

The presence and amount of elements added to silver in the alloy of the present invention are dictated by the ultimate use for the alloy. In one embodiment of the invention, the alloy includes at least from about 85% to about 95% of silver with the balance being made up of zinc, copper, indium, tin. Optionally, a small amount of iron may also be included. Desirably, the composition includes relative amounts of these elements in descending order, with the greatest amount being zinc and the least being iron.

Table 1 is a listing of elements which may be present in the silver alloy of the present invention including the preferred amount of each element. The silver alloys of the present invention contain as a minimum: silver, zinc, copper, indium and tin. The preferred ranges are indicated in Table 1. In addition, one or more other metals are added to enhance the features of the alloy. These metals and their preferred ranges are also listed in Table 1.

TABLE 1

| Element | Range of Weight Percent |
|---|---|
| Silver (Ag) | 85% to 95% |
| Zinc (Zn) | >0% to 5% |
| Copper (Cu) | >0% to 2% |
| Indium (In) | >0% to 1% |
| Tin (Sn) | >0% to 2% |
| Iron (Fe) | 0% to 1% |
| Gold (Au) | 0% to 2% |
| Silicon (Si) | 0% to 0.1% |
| Manganese (Mn) | 0% to 0.1% |
| Boron (B) | 0% to 0.1% |
| Bismuth (Bi) | 0% to 0.1% |
| Cobalt (Co) | 0% to 0.1% |
| Chromium (Cr) | 0% to 0.1% |
| Lead (Pb) | 0% to 0.1% |
| Vanadium (V) | 0% to 0.1% |
| Cerium (Ce) | 0% to 0.1% |
| Iridium (In) | 0% to 0.1% |
| Zirconium (Zr) | 0% to 0.1% |

The relative amounts of each element will be chosen to optimize the desired characteristics for each application. Generally, each component provides certain desirable characteristics, when provided in an alloy in a useful amount.

The presence of zinc adds to the whiteness of the alloy. Copper acts as a conventional hardening agent and adds malleability. Indium adds brilliance, ductility, and facilitates casting of the alloy. Tin adds to the hardness, malleability, ductility, and solderability of the alloy. Iron adds to the hardness of the alloy.

The alloy of the invention maintains superior color, while providing tarnish resistance and other qualities by the combination of the indicated elements in the chosen ranges. Conventionally, a certain amount of copper is necessary to provide sufficient hardness to the alloy. Experimentation with varying percentages of copper, however, indicates that levels usually used in silver alloys may result in less resistance to tarnish in the alloy of the present invention. The alloy of the present invention maintains sufficient hardness even in the presence of lower amounts of copper. Desirably, the amount of copper in the alloy is maintained below about 1.5% by weight of the composition.

The elements may be provided in any form, including for example, oxides, chlorides or elemental form. Preferably, the elements of the present invention are added in their elemental form as opposed to, for example, oxides or chlorides.

Each of the additional elements, either alone or in appropriate combination, can provide certain additional advantageous qualities to the final product being formed therefrom. These qualities include the ability to be cast, extruded, welded or soldered, reduction or elimination of fire scale, malleability and the ability to draw the alloy into a fine wire.

Useful qualities associated with the use of these additional elements in appropriate quantities include the following. Silicon acts to prevent fire scale, acts as a deoxidant, reduces the porosity of the recast alloy, and has a slight hardening effect. Manganese adds hardness and durability to the end product. Boron contributes to the elimination of fire scale. Bismuth aids in castability and solderability and also lowers the melting point of the alloy. Cobalt aids in preventing tarnish. Chromium contributes to the luster and hardness of the finished product. Lead adds to the malleability and castability of the alloy and helps control the melting range of the alloy. Vanadium adds brightness, ductility, resistance to oxidation and increases electrical conductivity. Cerium reduces adhesion of slag particles during casting or other manufacturing processes. Iridium adds corrosion resistance and hardness to the alloy. Zirconium im proves the conductivity of the alloy for use in electrical contacts and for other electrical applications.

Notably, cobalt separates from molten silver. However, when using certain preferred embodiments of the invention, it is possible for cobalt to dissolve into the molten silver. In this instance, the cobalt is able to contribute significantly to the anti-tarnish properties of the alloy.

The addition of various combinations of additional elements to the alloy of the invention can provide specialized alloys for various products. The specialized alloys maximize the desired qualities for particular products made therefrom. The following embodiments are illustrative of specialized alloys and products for which they are designed.

In a further embodiment of the present invention, a tarnish resistant silver alloy is provided including at least about 90% by weight of silver, from about 0.5% to about 1.5% of copper, from about 2% to about 5% of zinc, about 0.1% of indium and about 0.2% gold. Preferably, the alloy includes 93.8% silver, 1.25% copper, 4.5% zinc and 0.1000% indium.

More preferably, the alloy further includes at least one of: iron, silicon, manganese, boron, bismuth, cobalt, chromium and lead. Most preferably, the alloy includes each of the elements listed above.

Another embodiment of the present invention provides a tarnish resistant silver alloy useful in making extruded metal, including: from about 92% to about 95% by weight silver; from about 2% to about 5% by weight of zinc, from about 1% to about 1.5% by weight of copper and from about 0.05% to about 0.2% by weight of indium. Table 2 shows a particularly preferred embodiment of a tarnish resistant silver alloy useful in making extruded metal for use in jewelry.

TABLE 2

| Element | Preferred Weight % |
|---|---|
| Silver (Ag) | 94.848 |
| Zinc (Zn) | 0.5 |
| Copper (Cu) | 1.25 |
| Indium (In) | 0.10 |
| Tin (Sn) | 0.5 |
| Iron (Fe) | 0.005 |
| Gold (Au) | 0.2500 |
| Silicon (Si) | 0.035 |
| Manganese (Mn) | 0.001 |
| Boron (B) | 0.001 |
| Bismuth (Bi) | 0.002 |
| Cobalt (Co) | 0.0015 |
| Chromium (Cr) | 0.0005 |
| Lead (Pb) | 0.002 |
| Vanadium (V) | 0.001 |
| Cerium (Ce) | 0.001 |
| Iridium (In) | 0.001 |
| Zirconium (Zr) | 0.001 |

In a further embodiment of the present invention, a tarnish resistant silver alloy useful in making tea kettles is provided, including: from about 92% to about 95% by weight of silver, from about 2% to about 5% by weight of zinc, from about 1% to about 1.5% by weight of copper and from about 0.05% to about 0.2% by weight of indium. Table 3 shows a particularly preferred embodiment of a tarnish resistant silver alloy useful in making teapots.

TABLE 3

| Element | Preferred Weight % |
|---|---|
| Silver (Ag) | 93.0 |
| Zinc (Zn) | 3.895 |
| Copper (Cu) | 1.25 |
| Indium (In) | 0.10 |
| Tin (Sn) | 0.5 |
| Iron (Fe) | 0.005 |
| Gold (Au) | 0.300 |
| Silicon (Si) | 0.04 |
| Boron (B) | 0.001 |
| Bismuth (Bi) | 0.002 |
| Cobalt (Co) | 0.0015 |
| Chromium (Cr) | 0.001 |
| Vanadium (V) | 0.001 |
| Cerium (Ce) | 0.001 |
| Iridium (In) | 0.001 |
| Zirconium (Zr) | 0.001 |

Methods of Making Articles from the Alloy

Preparation of the silver alloy of the present invention may be performed using founding methods known to those skilled in the art. In one aspect of the invention, the alloy is formed into pellet-like shot for later use in casting processes. To form the shot, the alloy may be melted in a crucible to a suitable temperature. Depending on the melting point of the individual elements, the temperature will be at least the melting point of the element having the highest melting point. The alloy may then be poured into water and the granules so formed shaped into the form of shot for later use and handling.

In one method of making articles using the silver alloys of the invention, a user may pour a desired quantity of shot, melt it, and then cast it into the specific form desired. Investment casting is in widespread use for this purpose. This casting technique involves the formation of a mold into which the molten sterling silver alloy is poured. A mold may be created in the form to which the article will conform using the well known "lost wax" process.

Casting alloys into formed pieces using the lost wax process involves forming a mold by shaping a positive wax member into a wax tree. Removal of the wax from the wax tree forms the mold cavity or typically a series of interconnected cavities of the investment mold. This is achieved by placing the wax members and tree into a stainless steel tube or flask, which is filled with a mixture of plaster-of-paris and silica. The flask is then heated in an oven to approximately 1350° F. to harden the mixture and to melt the wax for the removal thereof. The flask is then cooled slowly to cure the mold.

The alloy of the present invention may then be poured or cast in the mold at a temperature of about 2200° F. so that the molten silver alloy enters the cavities in the mold and thereby forms the article(s). After cooling, the formed articles may be removed from the mold. This method allows for fine detail in complex pieces to be achieved and is often used in making complex articles of jewelry.

One problem associated with this method is that a certain amount of residue tends to remain in the trees after the article is removed therefrom. Using many conventional alloys it is not possible to recover the residue and add it back to virgin alloy for subsequent casting (reworked) without compromising the quality of the virgin alloy. However, it is possible, using the silver alloy of the invention, to rework residual alloy from the casting mold into virgin alloy. Significantly, it is possible to include up to about 50% of residual alloy in a virgin alloy and maintain high quality of jewelry or other pieces formed therefrom. This advance represents a significant cost savings in the manufacture of cast articles.

Another problem associated with casting silver alloys is the occurrence of undesirable oxides. Silver has a known affinity for oxygen, which affinity increases with temperature. When exposed to air, molten silver will absorb about twenty-two times its volume of oxygen. Like silver, copper also has a great affinity for oxygen, typically forming copper oxide. This may be of the cupric or cuprous variety, or both. Air must be excluded during the casting process to avoid excessive porosity of the cast article or the presence of undesirable internal voids. Thus, in melting sterling silver and other silver-copper alloys, care must be taken to prevent oxidation.

Copper oxide, also known as fire scale, is typically a darkened portion which blemishes the cast article. Such fire scale is not limited to the surface of the cast article, as in the case of conventional tarnishes, but may penetrate the article to some depth. In some cases, such fire scale may not be removed by buffing and polishing. Moreover, the opportunity for the creation of fire scale exists when the alloy is initially formed as shot, when such shot is melted and recast to form the desired article, and subsequently if the cast article is thereafter annealed. In each of these cases, the alloy is heated, and, given the opportunity, may form fire scale.

As previously noted, fire scale is more than a surface tarnish. Rather, it is a blemish which may permeate the cast article for some depth, and, in some cases, may not be removed by polishing. To the extent that it exists, the blemish caused by fire scale may lead to the rejection of as-cast parts. Moreover, such rejected parts may have to be re-refined into the elemental metals, and re-alloyed. Another advantage of the silver alloys of the present invention is that they are not as susceptible to the formation of fire scale during casting, as are other known alloys, in part because the present silver alloys uses less copper.

It is also possible to form the alloy into an article by melting the combined elements to a suitable temperature, casting into bars, followed by rolling and other mechanical forming into a desired shape. The article so formed may be subsequently polished, buffed with a suitable polish, and washed to remove fats and oils.

It is often necessary to perform additional steps in treating silver alloys when forming them into pieces by rolling and the like. For example, it is often necessary to anneal or otherwise treat an alloy in order to successfully form it using rolling and other mechanical means, in order to allow the piece to be formed without cracking or other damage. When using the silver alloys of the present invention, it is often possible to omit such steps and still obtain a superior rolled or formed product. The silver alloys of the present invention possess a desirable combination of strength and malleability which allow for such effective and cost savings in the various forming processes.

Other methods of forming, molding or casting the alloy will be readily apparent to those having ordinary skill in the art and are within the scope of the invention.

EXAMPLES

The examples of the present invention presented below are provided only for illustrative purposes and not to limit the scope of the invention. Numerous embodiments of the invention within the scope of the claims that follow will be apparent to those of ordinary skill in the art from reading the foregoing text and following examples.

Example 1

Silver Alloy of the Invention (OLS-7)

The following is an example of a silver alloy according to the present invention.

Example 1 Formulation

| Element | Weight (grams) | Weight % |
|---|---|---|
| Silver (Ag) | 281.49 | 93.8300 |
| Zinc (Zn) | 13.5 | 4.5000 |
| Copper (Cu) | 3.75 | 1.2500 |
| Indium (In) | 0.3 | 0.1000 |
| Gold (Au) | 0.6075 | 0.2025 |
| Tin (Sn) | 0.135 | 0.0450 |
| Iron (Fe) | 0.027 | 0.0090 |
| Silicon (Si) | 0.105 | 0.0350 |
| Manganese (Mn) | 0.006 | 0.0020 |
| Boron (B) | 0.003 | 0.0010 |
| Bismuth (Bi) | 0.003 | 0.0010 |
| Cobalt (Co) | 0.003 | 0.0010 |
| Chromium (Cr) | 0.003 | 0.0010 |
| Lead (Pb) | 0.0075 | 0.0025 |
| Vanadium (V) | 0.0075 | 0.0025 |
| Cerium (Ce) | 0.0075 | 0.0025 |

-continued

Example 1 Formulation

| Element | Weight (grams) | Weight % |
|---|---|---|
| Iridium (In) | 0.030 | 0.0100 |
| Zirconium (Zr) | 0.015 | 0.0050 |

The silver alloy of Example 1 was made by heating 300 grams silver to at least its melting point followed by addition of the additional elements. Each element was added individually and allowed to melt before addition of the subsequent element. The molten metal was maintained at a temperature of 1750° F. for 5 minutes. The alloy was then formed into an ingot and rolled into a sheet.

Example 2

Silver Alloy of the Invention (OLS-8)

The following is an example of a silver alloy according to the present invention.

Example 2 Formulation

| Element | Weight % |
|---|---|
| Silver (Ag) | 93.85 |
| Zinc (Zn) | 4.50 |
| Copper (Cu) | 1.496 |
| Indium (In) | 0.10 |
| Tin (Sn) | 0.045 |
| Iron (Fe) | 0.009 |

The silver alloy of Example 2 was made in accord with the procedure described above for Example 1.

Example 3

Comparative Example (OLS-9)

The following is an example of another commercially available sterling silver alloy obtained from the manufacturer (Leach and Garner, Attleboro, Mass.) in the form of a sheet.

Example 3 Formulation

| Element | Weight % |
|---|---|
| Silver (Ag) | 92.50 |
| Copper (Cu) | 6.60 |
| Lithium (Li) | 0.05 |

Example 4

Comparative Example (OLS-10)

The following is a further example of a commercially available sterling silver alloy. This alloy was obtained from the manufacturer (Leach and Garner, Attleboro, Mass.) in the form of a sheet.

| Example 4 Formulation | |
|---|---|
| Element | Weight % |
| Silver (Ag) | 92.50 |
| Zinc (Zn) | 5.10 |
| Copper (Cu) | 1.50 |
| Tin (Sn) | 0.85 |

Example 5

Comparative Example (NAGAOKA)

The following is an example of a commercially available sterling silver alloy used in jewelry. This alloy was obtained from the manufacturer (Nagaoka Co., Ltd., Nagaoka, Japan) in the form of a sheet.

Example 6

Comparative Example (ULTRAFINE)

The following is a conventional alloy used in jewelry and sold under the tradename ULTRAFINE SILVER™ (available from Stern-Leach, Attleboro, Mass.).

| Example 6 Formulation | |
|---|---|
| Element | Weight Percent |
| Silver (Ag) | 99.76 |
| Zinc (Zn) | 0.0253 |
| Copper (Cu) | 0.3830 |
| Iron (Fe) | 0.0024 |
| Silicon (Si) | 0.0016 |
| Manganese (Mn) | 0.1671 |
| Calcium (Ca) | 0.0001 |
| Cadmium (Cd) | 0.0003 |
| Sodium (Na) | 0.0017 |
| Nickel (Ni) | 0.0019 |
| Phosphorus (P) | 0.0053 |
| Palladium (Pd) | 0.0005 |

The silver alloy of Example 6 was made by heating 300 grams of silver to at least its melting point followed by addition of the additional elements. Each element was added individually and allowed to melt before addition of the subsequent element. The molten metal was maintained at a temperature of 2012° F. for 5 minutes. The alloy was then cast into rings. The forming step required substantial annealing.

Example 7

Tarnish Resistance

The tarnish resistance of the alloys of Examples 1 and 2 were tested and compared to those of Examples 3 to 6. The following protocol was used to evaluate tarnish resistance.

A tarnish producing environment was created by adding a solution of ammonium polysulfide to a beaker and placing the beaker under a wire rack in a sealed chamber containing the test samples. The beaker was kept a suitable distance from test samples so that the hostile fumes were evenly distributed throughout the sealed chamber. The atmosphere generated sulfide fumes at a concentration of about 10,000 ppm. The proper duration of exposure to reach maximum discoloration was evaluated by placing a control (non-tarnish-resistant sterling silver) in the tarnish producing environment and found to be six hours.

Polished and degreased samples made from alloys as described in the examples were placed upon a wire rack in the sealed chamber as described above. The samples were tested simultaneously in the same chamber to assure equality of exposure conditions. The samples were kept in the sealed container for 6 hours and then visually examined. The sample of Example 1 showed no visible discoloration. The sample of Example 2 showed only minor discoloration. The samples of Examples 3 to 6 were each severely blackened. The results show that the silver alloy of the present invention possesses superior tarnish resistance as compared to a conventional silver alloy.

Example 8

Tarnish Resistance Over Time

Tarnish resistance over time of the alloy of Examples 1 and 2 as compared to that of Examples 3 to 6 was evaluated. After exposure to the tarnish producing environment as described above, the samples were allowed to remain in ambient air for 19 months. A visual inspection of the examples at the end of a 19 month test period are summarized in Table 4 below.

TABLE 4

| Example | Visual Appearance after 19 Months |
|---|---|
| Example 1 (QLS-7) | No Tarnish |
| Example 2 (QLS-8) | Mild Tarnish |
| Example 3 (QLS-9) | Severe Tarnish |
| Example 4 (QLS-10) | Severe Tarnish |
| Example 5 (NAGAOKA) | Severe Tarnish |
| Example 6 (ULTRAFINE) | Severe Tarnish |

After 19 months, the sample of Example 1 showed no visible discoloration. The sample of Example 2 showed only mild tarnishing. In contrast, the samples of Examples 3 to 6 were all severely tarnished. These results are shown in the figure, which is a photograph of the samples after exposure to the tarnish producing atmosphere and exposure to ambient air for 19 months thereafter. The results show that the silver alloys of the present invention possesses superior tarnish resistance as compared to conventional silver alloys.

Although illustrative embodiments of the present invention have been described herein with reference to the accompanying drawings, it is to be understood that the present disclosure is to be considered as exemplary of the principles of the invention and is not intended to be limited to those precise embodiments, and that various other changes and modifications may be effected therein by one skilled in the art without departing from the scope or spirit of the invention.

What is claimed is:

1. A tarnish resistant silver alloy, comprising:

at least about 85% by weight of silver, and a balance of said alloy including zinc, copper, indium tin and iron.

2. The alloy of claim 1, further comprising at least one of gold, silicon, manganese, boron, bismuth, cobalt, chromium and lead.

3. The alloy of claim 2, wherein said alloy includes gold, silicon, manganese, boron, bismuth, cobalt, chromium and lead.

4. The alloy of claim 3, further comprising at least one of vanadium, cerium, iridium and zirconium.

5. The alloy of claim 4, wherein said alloy includes vanadium, cerium, iridium and zirconium.

6. The alloy of claim 1, wherein:

(a) said silver (Ag) is present in an amount of at least about 92.5% by weight;

(b) said zinc (Zn) is present in an amount of about 5% or less by weight;

(c) said copper (Cu) is present in an amount of about 2% or less by weight; and (d) said indium (In) is present in an amount of about 0.2% or less by weight.

7. The alloy of claim 1, wherein said silver, zinc, copper, tin and indium are each present in elemental form.

8. The alloy of claim 1, further comprising at least one of: gold (Au) in an amount of about 0.5% or less by weight and silicon (Si) in an amount of about 0.5% or less by weight.

9. The alloy of claim 1, wherein:

(a) said silver is present in an amount of about 93.8% by weight; and (b) said copper is present in an amount of about 1.25% by weight.

10. The alloy of claim 9, wherein said indium is present in an amount of about 0.1% by weight.

11. The alloy of claim 10, wherein said zinc is present in an amount of about 4.5% by weight.

12. The alloy of claim 1, further comprising at least one of the group consisting of: silicon (Si), manganese (Mn), boron (B), bismuth (Bi), cobalt (Co), chromium (Cr), lead (Pb), vanadium (V), cerium (Ce), iridium (Ir), and zirconium (Zr).

13. The alloy of claim 12, wherein:

(a) said B, Bi, Co, and Cr, if present, are each in an amount of up to about 0.0010% by weight;

(b) said Pb, V, and Ce, if present, are each in an amount of up to about 0.0025% by weight;

(c) said Fe is in an amount of about 0.009% or less by weight;

(d) said Si, if present, is in an amount of about 0.035% or less by weight;

(e) said Ir, if present, is in an amount of about 0.01% or less by weight; and (f) said Zr, if present, is in an amount of about 0.005% or less by weight.

14. An article made from the alloy of claim 1.

15. The article of claim 14, wherein said article is one of a bracelet, a ring, and a tea kettle.

16. A tarnish resistant sterling silver alloy, comprising:

(a) silver in an amount of from about 92.5% to about 95% by weight;

(b) zinc in an amount of about 5% or less by weight;

(c) copper in an amount of about 1.5% or less by weight;

(c) indium in an amount of about 0.2% or less by weight;

(d) tin in an amount of about 2%;

(e) iron; and (f) at least one further element selected from the group consisting of: gold (Au), copper (Cu), indium (In), zinc (Zn), tin (Sn), iron (Fe), silicon (Si), manganese (Mn), boron (B), bismuth (Bi), cobalt (Co), chromium (Cr), lead (Pb), vanadium (V), cerium (Ce), iridium (In), and zirconium (Zr).

17. The alloy of claim 16, wherein:

(a) said zinc (Zn) is present in an amount of from about 2% to about 5% by weight;

(b) said copper (Cu) is present in an amount of from about 1% to about 1.5% by weight;

(c) said indium (In) is present in an amount of from about 0.05% to about 0.2% by weight;

(d) said B, Bi, Co, and Cr, if present, are each in an amount of about 0.0010% by weight;

(e) said Pb, V, and Ce, if present, are each in an amount of about 0.0025% by weight;

(f) said Fe, is in an amount of about 0.009% by weight;

(g) said Si, if present, is in an amount of about 0.035% by weight;

(h) said Ir, if present, is in an amount of about 0.01% by weight; and (g) said Zr, if present, is in an amount of about 0.005% by weight.

18. An article made from the alloy of claim 16.

19. The article of claim 18, wherein said article comprises one of a ring, a bracelet and a tea kettle.

20. A method of making an article comprising the steps of:

(a) pre-forming an alloy according to claim 1 into a pre-formed piece;

(b) melting said piece to form a melt;

(c) casting said melt into a mold to form a cast article;

(d) cooling said cast article; and (e) removing said article from said mold.

21. The method of claim 20, further comprising the step of:

(f) reworking residual alloy remaining in said mold into a virgin alloy for subsequent use in making subsequent articles of jewelry.

* * * * *

UNITED STATES PATENT AND TRADEMARK OFFICE

CERTIFICATE OF CORRECTION

PATENT NO. : 6,841,012 B2
DATED : January 11, 2005
INVENTOR(S) : Scott M Croce

It is certified that error appears in the above-identified patent and that said Letters Patent is hereby corrected as shown below:

Title page,
Item [74], delete "*Attorney, Agent or Firm* - Hoffman & Baron, LLP" and insert -- *Attorney, Agent or Firm* - Hoffmann & Baron, LLP --.

Column 1,
Line 16, delete "Silver alloys has been used…" and insert -- Silver alloys have been used --.

Column 7,
Line 44, delete "...Invention (OLS-7)…" and insert -- Invention (QLS-7) --.

Column 8,
Line 22, delete "...Invention (OLS-8)…" and insert -- Invention (QLS-8) --.
Line 37, delete "...made in accord with…" and insert -- made in accordance with --.
Line 43, delete "...Example (OLS-9)…" and insert -- Example (QLS-9) --.
Line 63, delete "...Example (OLS-10)…" and insert -- Example (QLS-10) --.

Column 10,
Line 60, delete "...copper, indium tin…" and insert -- copper, indium, tin --.

Signed and Sealed this

Nineteenth Day of April, 2005

JON W. DUDAS
*Director of the United States Patent and Trademark Office*

US006841012C1

(12) EX PARTE REEXAMINATION CERTIFICATE (5918th)

United States Patent

Croce

(10) Number: US 6,841,012 C1

(45) Certificate Issued: Oct. 2, 2007

(54) ANTI-TARNISH SILVER ALLOY

(75) Inventor: Scott M. Croce, East Brunswick, NJ (US)

(73) Assignee: Steridyne Laboratories, Inc., East Brunswick, NJ (US)

Reexamination Request:
No. 90/007,833, Dec. 1, 2005

Reexamination Certificate for:

| | |
|---|---|
| Patent No.: | **6,841,012** |
| Issued: | **Jan. 11, 2005** |
| Appl. No.: | **10/636,006** |
| Filed: | **Aug. 7, 2003** |

Certificate of Correction issued Apr. 19, 2005.

Related U.S. Application Data

(60) Provisional application No. 60/466,207, filed on Apr. 29, 2003.

(51) Int. Cl.

| | |
|---|---|
| ***C22C 5/00*** | (2006.01) |
| ***C22C 5/06*** | (2006.01) |
| ***C22C 5/08*** | (2006.01) |
| ***C22C 5/10*** | (2006.01) |

(52) U.S. Cl. ..... 148/430; 420/504; 420/506

(58) Field of Classification Search ..... None
See application file for complete search history.

(56) References Cited

U.S. PATENT DOCUMENTS

| | | | | | |
|---|---|---|---|---|---|
| 3,811,876 | A | * | 5/1974 | Harigaya et al. | 420/504 |
| 4,453,977 | A | * | 6/1984 | Burns et al. | 75/255 |
| 4,810,308 | A | * | 3/1989 | Eagar et al. | 148/538 |
| 4,869,757 | A | * | 9/1989 | Eagar et al. | 148/678 |
| 4,973,446 | A | | 11/1990 | Bernhard et al. | |
| 5,021,214 | A | | 6/1991 | Sasaki et al. | |
| 5,037,708 | A | * | 8/1991 | Davitz | 428/673 |
| 5,039,479 | A | * | 8/1991 | Bernhard et al. | 420/504 |
| 5,171,643 | A | * | 12/1992 | Suzuki et al. | 428/671 |
| 5,558,833 | A | * | 9/1996 | Zamojski | 420/502 |
| 5,653,827 | A | | 8/1997 | Kramer et al. | |
| 5,817,195 | A | * | 10/1998 | Davitz | 148/430 |
| 5,853,505 | A | | 12/1998 | Brauer et al. | |
| 5,882,441 | A | * | 3/1999 | Davitz | 148/430 |
| 6,139,652 | A | * | 10/2000 | Carrano et al. | 148/431 |
| 6,726,877 | B1 | * | 4/2004 | Eccles | 420/504 |

FOREIGN PATENT DOCUMENTS

| | | |
|---|---|---|
| WO | WO 95/14112 | 5/1995 |

OTHER PUBLICATIONS

Ferriera, et al., "Microestrutural Evolution in a CuZnAl Shape Memory Alloy: Kinetics and Morphological Aspects," Mat. Res. vol. 3, No. 4, São Carlos, pp. 1–9, Oct. 2000.

Greetham, "Phosphor Bronze: Teaching an Old Dog New Tricks," Innovations, the online magazine from the Copper Development Association, pp. 1–8, Jun. 2001.

Gainsbury, P.E., "Grain Refinement of Standard Silver by Additions of Iron," Project Report 1b/4/S, Technical Advisory Committee, Worshipful Company of Goldsmiths, pp. 1–9, Sep. 1970.

Shaw, E.A., "Grain Refinement of Standard and Britannia Silver by the Addition of Cobalt," Project Report 1b/5, Technical Advisory Committee, Worshipful Company of Goldsmiths, pp. 1–13, Aug. 1972.

Technical Advisory Committee, Technical Development Officer's Annual Report 1969/70, The Worshipful Company of Goldsmiths, pp. 1–6.

Technical Advisory Committee, Technical Development Officer's Annual Report 1971/72, The Worshipful Company of Goldsmiths, pp. 1–6.

Standard Specification for Refined Silver, ASTM International, ASTM Standard B, Designation 413–97a.

* cited by examiner

*Primary Examiner*—Jerry D. Johnson

(57) ABSTRACT

An anti-tarnish silver alloy is provided including at least about 85% silver, with the balance including zinc, copper, indium, and tin. Also provided are articles made from the alloy and methods of making the articles.

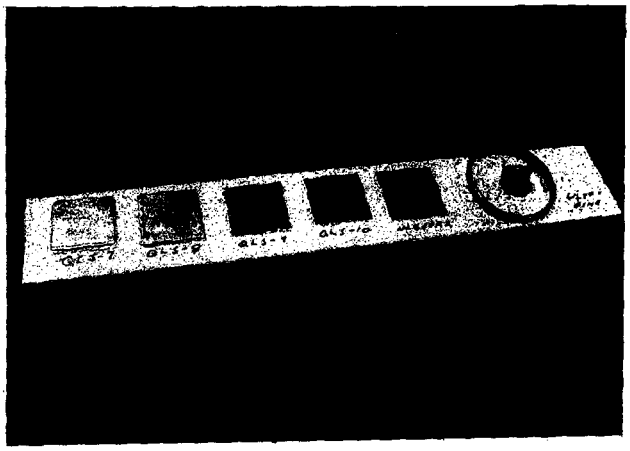

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 13 and 16 are determined to be patentable as amended.

Claims 2, 4–12, 14, 15 and 17–21, dependent on an amended claim, are determined to be patentable.

New claim 22 is added and determined to be patentable.

1. A tarnish resistant silver alloy, comprising:

at least about 85% by weight of silver, and a balance of said alloy including zinc, copper, indium, tin and iron, *wherein said iron is present in an amount of 0.005% to about 1% by weight of said alloy and said iron is present in elemental form*.

3. [The alloy of claim 2, wherein said alloy includes] *A tarnish resistant silver alloy, comprising:*

*at least about 85% by weight of silver, and a balance of said alloy including zinc, copper, indium, tin, iron,* gold, silicon, manganese, boron, bismuth, cobalt, chromium and lead.

13. The alloy of claim 12, wherein:

(a) said B, Bi, Co, and Cr, if present, are each in an amount of up to about 0.0010% by weight;

(b) said Pb, V, and Ce, if present, are each in an amount of up to about 0.0025% by weight;

(c) said Fe is in an amount of *0.005% to* about 0.009% [or less] by weight;

(d) said Si, if present, is in an amount of about 0.035% or less by weight;

(e) said Ir, if present, is in an amount of about 0.01% or less by weight; and (f) said Zr, if present, is in an amount of about 0.005% or less by weight.

16. A tarnish resistant sterling silver alloy, comprising:

(a) silver in an amount of from about 92.5% to about 95% by weight;

(b) zinc in an amount of about 5% or less by weight;

(c) copper in an amount of about 1.5% or less by weight;

(c) indium in an amount of about 0.2% or less by weight;

(d) tin in an amount of about 2%;

(e) iron *in an amount of 0.005% to about 1% by weight, said iron being present in elemental form*; and (f) at least one further element selected from the group consisting of: gold (Au), copper (Cu), indium (In), zinc (Zn), tin (Sn), iron (Fe), silicon (Si), manganese (Mn), boron (B), bismuth (Bi), cobalt (Co), chromium (Cr), lead (Pb), vanadium (V), cerium (Ce), iridium (In), and zirconium (Zr).

*22. The alloy of claim 1, wherein said copper is present in an amount of greater than 0% and less than about 1.5% by weight of said alloy.*

* * * * *